US005667110A

United States Patent [19]

McCann et al.

[11] Patent Number: 5,667,110

[45] Date of Patent: *Sep. 16, 1997

[54] BEVERAGE DISPENSER FOR HOME OR OFFICE

[76] Inventors: Gerald P. McCann, 7000 Macapa Dr., Los Angeles, Calif. 90068; Donald J. Verley, 43015 Lesina Dr., Lake Elizabeth, Calif. 93532

[ * ] Notice: The term of this patent shall not extend beyond the expiration date of Pat. No. 5,499,758.

[21] Appl. No.: 578,750

[22] Filed: Dec. 26, 1995

Related U.S. Application Data

[63] Continuation of Ser. No. 293,055, Aug. 19, 1994, Pat. No. 5,499,758.

[51] Int. Cl.[6] ..... B67D 5/42

[52] U.S. Cl. ..... 222/386.5; 222/400.7; 222/464.1

[58] Field of Search ..... 222/95, 386.5, 222/400.7, 464.1, 105, 319, 389, 396, 397

[56] References Cited

U.S. PATENT DOCUMENTS

| | | | |
|---|---|---|---|
| 1,977,862 | 10/1934 | Scholtes | 225/11 |
| 3,080,093 | 3/1963 | Wilson . | |
| 3,233,779 | 2/1966 | Cornelius . | |
| 3,244,326 | 4/1966 | Bull, Jr. . | |
| 3,294,289 | 12/1966 | Bayne et al. . | |
| 3,300,102 | 1/1967 | Budzich | 222/386.5 |
| 4,120,425 | 10/1978 | Bethrum | 222/146 |
| 4,142,657 | 3/1979 | Wanke . | |
| 4,265,374 | 5/1981 | Sebalos | 222/400.7 |
| 4,470,526 | 9/1984 | Cha et al. | 222/389 |
| 4,482,072 | 11/1984 | Hankins . | |
| 4,763,818 | 8/1988 | Stefano et al. | 222/289 |
| 4,809,884 | 3/1989 | Stackhouse . | |
| 4,881,666 | 11/1989 | Tullman et al. . | |
| 4,955,512 | 9/1990 | Sharples . | |
| 4,984,713 | 1/1991 | Chambers et al. . | |
| 5,040,001 | 8/1991 | Dunn et al. | 346/140 |
| 5,180,081 | 1/1993 | McCann | 222/400.7 |
| 5,499,758 | 3/1996 | McCann et al. | 222/386.5 |

FOREIGN PATENT DOCUMENTS

| | | | |
|---|---|---|---|
| 6478780 | 6/1981 | Australia | B67D 1/10 |
| 1589518 | 4/1970 | France . | |
| 2623488 | 5/1989 | France | B67D 1/04 |
| 4125584 | 2/1992 | Germany | B67D 1/04 |
| 8900544 | 1/1989 | WIPO | B67D 1/04 |

*Primary Examiner*—Gregory L. Huson

[57] ABSTRACT

A beverage dispensing system that fits inside a completely filled standard beverage container with minimal displacement of the beverage level. A fastener attaches the dispenser to the spout portion of the container. An inflatable bladder pressurizes the beverage at all times. Pressure tubing connects the bladder to a pressure sensor and a pressure source. A pin controls the flow of gas through the pressure tubing. Gas can flow into the bladder when the dispenser is attached to the container. Gas is purged out of the bladder and pressure tubing before the dispenser is removed from the container. A draw tube conducts the beverage under pressure from the container, through beverage exit tubing, out to be dispensed.

20 Claims, 2 Drawing Sheets

BEVERAGE DISPENSER FOR HOME OR OFFICE

This is a continuation of application Ser. No. 08/293,055 filed on Aug. 19, 1994 and now U.S. Pat. No. 5,499,758.

BACKGROUND OF THE INVENTION

1. Field of the Invention

The present invention relates to beverage dispensers and preservers.

2. Description of the Related Prior Art

Many of the beverage dispensers presently on the market are commercial in nature and are complicated to use. Others do not both dispense the beverage and preserve its original quality.

The most common devices require a special container to store the beverage. Such a container is impractical since it requires the consumer to purchase additional hardware. A special container further requires additional storage space. It also complicates use since it requires the consumer to transfer the beverage from its original container into the special one.

Some devices also incorporate a bladder inside the special container. As the beverage is consumed, the bladder inflates with gas to apply pressure to the beverage remaining in the container. In this manner carbonation is preserved and the beverage can be dispensed by pressure pouring. Other devices pressurize the beverage by applying gas directly to the beverage, without the use of a bladder. If the gas is air, the beverage will oxidize, achieving a poor taste. If the gas is carbon dioxide ($CO_2$), the beverage will accumulate excess carbonation. This will alter its intended taste and will cause the beverage to foam when dispensed. Finally, there are beverage dispensers or preservers on the market which are not designed both to maintain the carbonation of the beverage and to dispense the beverage by pressure pouring.

In an alternative device, a bladder is utilized to apply pressure to the beverage in its original container. This system, found in U.S. Pat. No. 4,482,072, does not make use of a special container. However, the system is inconvenient to use because the bladder does not fit into a full beverage container. Some of the beverage must be removed before the bladder will fit. If this is not done correctly, part of the beverage will spill as the bladder is inserted into the container. On the other hand, removing some of the beverage might be inconvenient for the user if the user does not presently intend to consume the removed beverage. Finally, some carbonation will escape during the beverage removal process.

SUMMARY OF THE PRESENT INVENTION

The beverage dispensing system of the present invention includes an inflatable bladder that is inserted in the original beverage container. Along with the bladder, a draw tube is inserted in the original beverage container. The bladder and draw tube fit inside a completely filled container with minimal displacement of the beverage level. As the bladder inflates, it applies pressure to the beverage, whereby the beverage is pushed up the draw tube. The bladder continues to inflate as the beverage is gradually consumed. Thus, the bladder pressurizes the beverage at all times. Furthermore, the bladder prevents the beverage from coming into contact with any gas. In this manner, the quality of the beverage is preserved after a quantity of beverage has been consumed.

The beverage dispensing system of the present invention further includes an attachment means which readily connects the dispenser to the spout portion of any standard beverage container. Finally, the beverage dispensing system of the present invention includes conduits for gas flow to inflate the bladder, and for liquid flow to dispense the beverage coming up the draw tube.

Accordingly, it is an object of the present invention to provide a beverage dispensing system that dispenses beverages directly from their completely filled original containers.

It is another object of the present invention to preserve the quality of the beverage as it is found in its original container.

Other and further objects and advantages of the present invention will appear hereinafter.

DETAILED DESCRIPTION OF THE PREFERRED EMBODIMENT

The preferred embodiment will now be described in detail with reference to the drawings. Like elements appearing in multiple drawings are similarly numbered.

Figure 1:
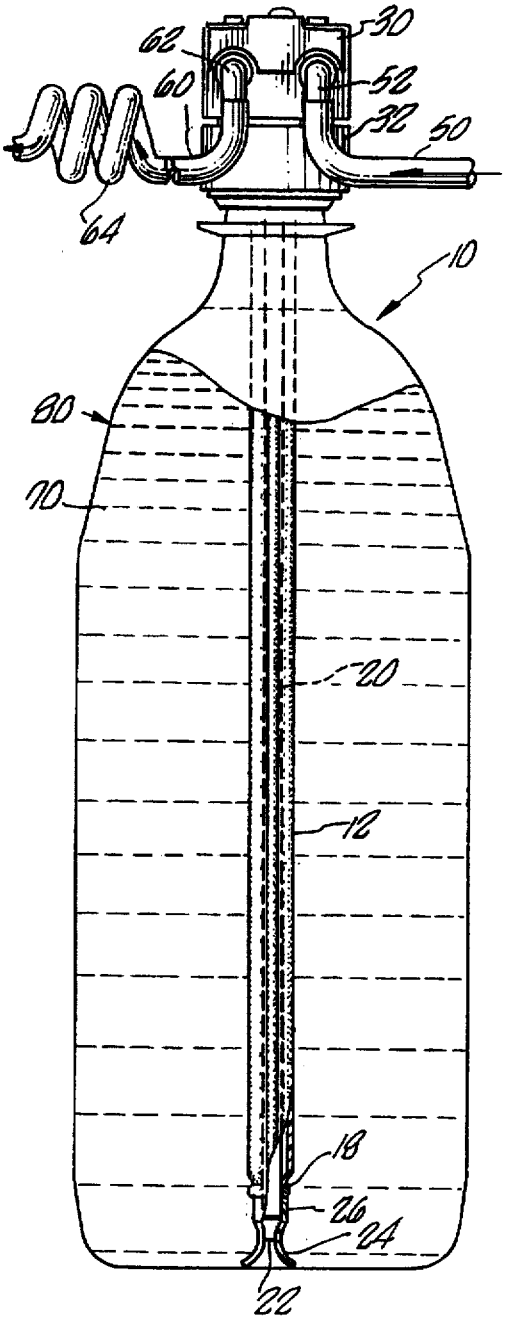
FIG. 1 is a cross-sectional view through the center of a beverage container employing the present invention in an unexpanded configuration.

FIG. 1 illustrates a standard beverage container 80 employing the beverage dispensing system 10 of the present invention. The container 80 is filled with beverage 70. The preferred embodiment uses a standard 1, 2, or 3-liter PET soda bottle for the container 80. Alternate embodiments can use other standard or special containers. The preferred embodiment further uses carbonated beverages for the beverage 70. However, other beverages such as wine or fruit juices can be dispensed. Indeed, any liquid can be used, even if not intended for human consumption.

Figure 2:
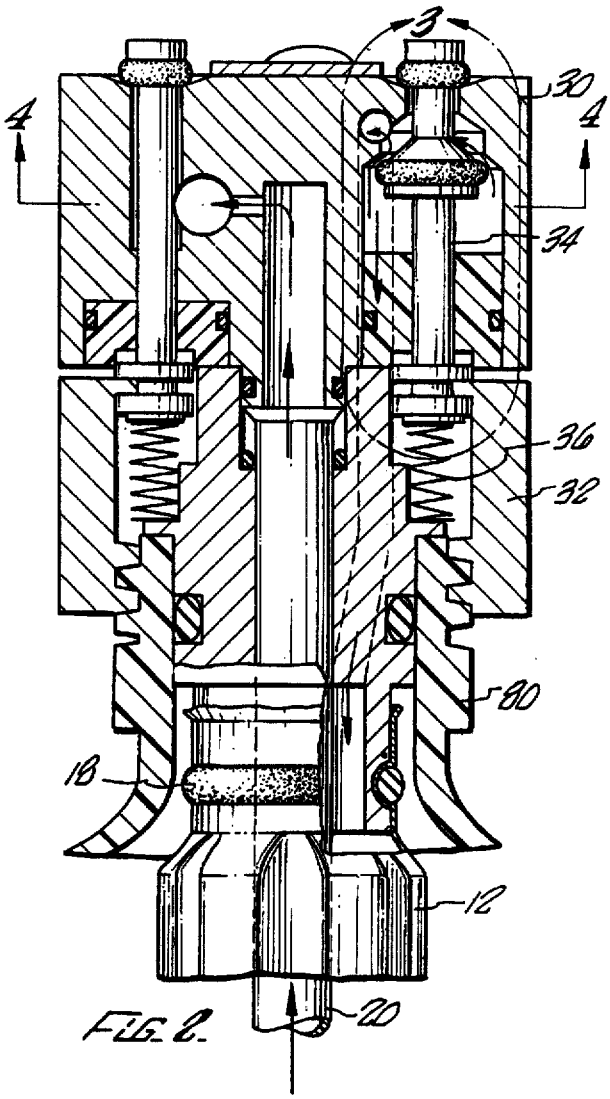
FIG. 2 is a cross-sectional view through the center of the housing employed by the present invention.

A housing 30 connects the beverage dispensing system 10 to the spout portion of the container 80 as seen in FIG. 2. The housing 30 also connects the elements to each other as described hereinafter.

A fastener 32 slides on the outside of the housing 30. A pin 34 resides inside the housing 30. A pressure nozzle 52 and a beverage exit nozzle 62 penetrate the housing 30. Inside the housing 30, a bladder 12 attaches to the pressure nozzle 52 and a draw tube 20 attaches to the beverage exit nozzle 62. Outside the housing 30, a pressure tube 50 attaches to the pressure nozzle 52 and a beverage exit tube 60 attaches to the beverage exit nozzle 62.

In the preferred embodiment, the housing 30 is cylindrical and sized to allow the elements and connections described above. In other embodiments, the housing 30 could be missing, or shaped differently. In yet other embodiments, the elements could attach in different configurations.

The fastener 32 allows for the selective attachment of the beverage dispensing system 10 to the container 80. In the preferred embodiment, the fastener 32 is a nut attached to the housing 30. The nut has internal threads matched to the external threads provided on the spout portion of the container 80. In other embodiments, the fastener 32 could be any other fastening device, such as a coupler, a latch, or a common snap-on device.

The pin 34 controls the flow of gas through the pressure nozzle 52 into the bladder 12. The pin 34 is designed to cover the duct of the pressure nozzle 52. As the fastener 32 is turned to either connect or disconnect the assembly to or from the container 80, the pin 34 moves to either open or close the duct of the pressure nozzle 52, respectively. The pin 34 is activated by a spring 36.

Figure 5A:
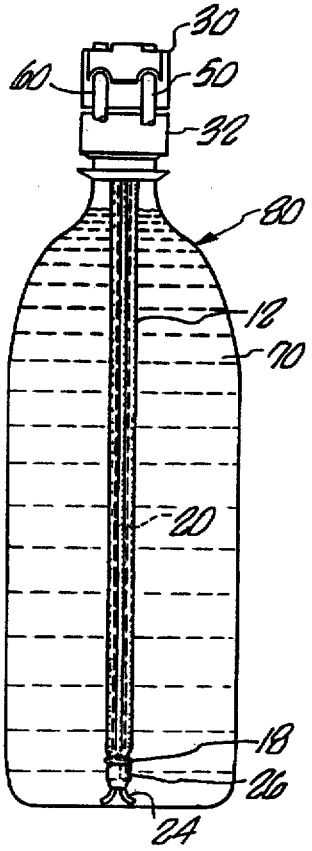
FIGS. 5*a* through 5*c* are cross-sectional views through the center of a beverage container employing the present invention in various expanded configurations.
Figure 5B:
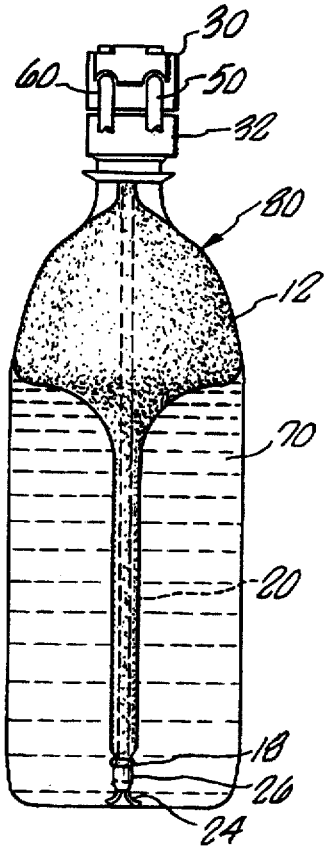
Figure 5C:
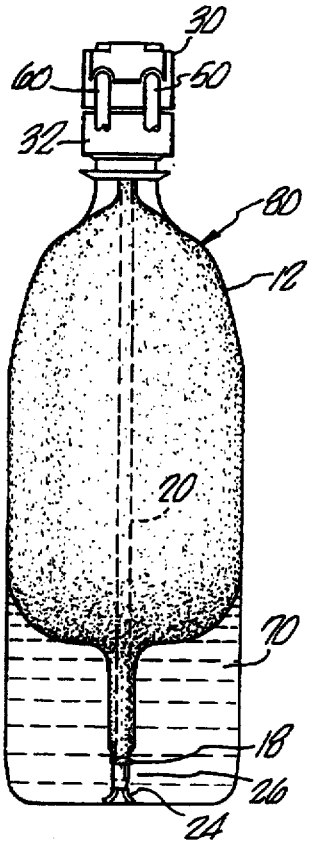

The bladder 12 is inserted in its original unexpanded configuration into the container 80. The bladder 12 is depicted in its original unexpanded configuration in FIG. 1, and in various expanded configurations in FIG. 5.

In the preferred embodiment, the bladder 12 is an inflatable elongated body with wall thickness gradually increasing from its upper section to its lower section. This design allows the upper section of the bladder 12 to expand gradually in the empty space above the beverage 70. Thereafter, as the beverage 70 is consumed, the lower section of the bladder 12 starts to expand gradually as well.

In the preferred embodiment, the bladder 12 is comprised of latex-based rubber. The preferred material is designed to prevent plastic deformation as the bladder 12 is inflated and pressurized up to 110 psi numerous times. The bladder 12, therefore, expands sideways only. It also minimizes beverage dripping when the bladder 12 is removed from the container 80. The preferred material is also designed to fit inside the container 80 completely filled as pre-packaged with beverage 70, with minimal displacement of the beverage level.

Figure 3:
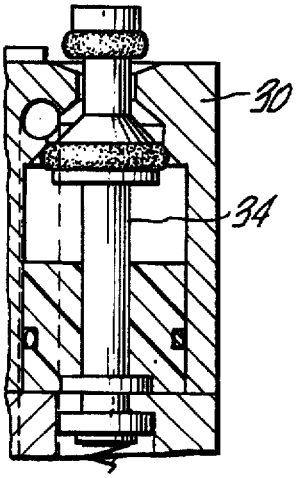
FIG. 3 is a detailed view of the pin employed by the present invention in a closed configuration.
Figure 4:
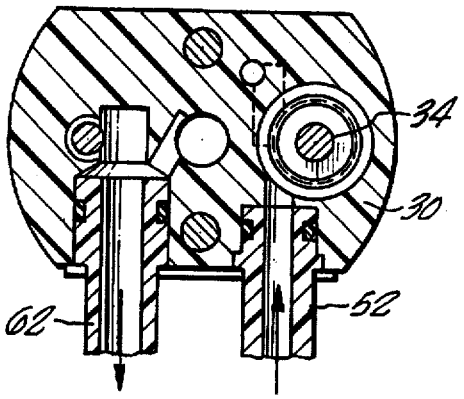
FIG. 4 is a cross-sectional view through the housing of FIG. 2.

As shown in FIG. 3, the draw tube 20 enters the upper section, passes through the center, and exits the lower section of the bladder 12. The bladder 12 has two rubber rings 18, one in the upper section and one in the lower section, to retain the bladder 12 to the draw tube 20.

In the preferred embodiment, the draw tube 20 is a cylindrical body. Its outer diameter is small enough to fit inside the bladder 12 in its unexpanded state. Its inside diameter is sized to allow the beverage 70 to pass through. At its lowermost end, the draw tube 20 has an aperture 22 that rests on the bottom of the container 80.

A plurality of flanges 24 is attached to the lowermost end of the draw tube 20 to prevent the bladder 12 from expanding over the aperture 22. In the preferred Embodiment, there are two flanges 24 which are attached to an extension collar 26 which is, in turn, attached over the ends of the bladder 12 and draw tube 20.

The bladder 12, draw tube 20, extension collar 26, and flanges 24 are all comprised of materials approved by the FDA for use with food. The preferred materials will not release any toxic substance which may contaminate or give an off-taste to the beverage. The preferred materials will also withstand higher temperatures for easy cleaning.

A pressure tube 50 connects the bladder 12, through the pressure nozzle 52, to a pressure sensing device and a pressure source such as a hand pump, an air compressor, or a carbon dioxide ($CO_2$) supply. The pressure tube 50 is a hose designed for pressure sources. The pressure sensing device causes the pressure source to turn on and off as the beverage 70 is removed from the container 80.

A beverage exit tube 60 connects the draw tube 20 through the beverage exit nozzle 62 to a beverage dispensing faucet. The beverage exit tube 60 is also a hose made out of a material which is designed to be a beverage conduit and which is approved by the FDA for use with food.

Between the beverage exit tube 60 and the beverage dispensing faucet is a coiled tube 64. The coiled tube 64 has an inside diameter smaller than the inside diameter of the beverage exit tube 60. The coiled tube 64 creates a pressure drop, allowing the beverage 70 to be dispensed gently through the faucet without foam or further carbonation loss. In alternate embodiments, the pressure drop can be effected by other means, or avoided altogether.

In the preferred embodiment, the beverage dispensing system 10 of the present invention operates as follows. A new standard beverage container 80, completely filled with beverage 70, is opened. The bladder 12 and draw tube 20 are inserted into the container 80. As the fastener 32 is turned to connect the assembly to the top of the container 80, the pin 34 moves to open the duct of the pressure nozzle 52. In this manner, gas is allowed to flow from the pressure source through the pressure tube 50 and pressure nozzle 52 into the bladder 12. As the bladder 12 is inflated, it applies pressure to the beverage 70 and the walls of the container 80. In this manner, the beverage 80 is forced up the draw tube 20 through the beverage exit nozzle 62, the beverage exit tube 60, the coiled tube 64, and out the beverage dispensing faucet. As the beverage 70 in the container 80 is consumed, the pressure sensor signals the need for more gas. The pressure source, then, inflates the bladder 12 further to keep the remaining beverage 70 under constant pressure. In this manner, carbonation is preserved until the beverage 70 is entirely consumed.

Since the bladder 12 pushes all the beverage 70 up the draw tube 20, virtually the entire beverage 70 in the container 80 can be dispensed. When desired, the fastener 32 can be turned to disconnect the system 10 from the container 80. The pin 34 moves to close the duct of the pressure nozzle 34. The bladder 12 and pressure tube 50 are now purged. The beverage dispensing system 10 is now readily removed from the container 80 and is ready to be cleaned and re-used numerous times.

In the preferred embodiment, the beverage dispensing system of the present invention is mounted in a refrigerator door. Several beverage containers can be placed in a special rack inside the refrigerator and connected in parallel or in series to the dispenser. In other embodiments, the system could be installed into a small refrigerator designed specifically for this device or into a standard small refrigerator modified for faucet and drain tray mounting. Such devices would house the desired number of beverage containers. These devices could be placed in an office as self-operated dispensers for employee use. Furthermore, a number of reserve beverage containers could be joined in series so that the consumer does not have to replace the containers frequently. However, the beverage dispensing system of the present invention can function in numerous other configurations well known to those skilled in the art.

Thus, a beverage dispensing system is disclosed which employs an inflatable bladder and a draw tube to dispense beverage directly out of its completely filled original container, to pressurize the beverage, and to maintain the original quality of the beverage. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed:

1. A liquid dispensing system for use with a container holding liquid and having a container aperture, said dispensing system comprising:

a) a fastener adapted to attach to said container such that said container aperture is sealed;

b) a liquid exit nozzle attached to said fastener, said exit nozzle including a controller adapted to selectively allow passage of liquid through said exit nozzle;

c) a liquid draw tube connected to said exit nozzle and adapted to be placed inside of said container when said fastener is attached to said container;

d) a pressure source capable of providing and sustaining pressure higher than the pressure inside said container;

e) a pressure nozzle connected to said pressure source, said pressure nozzle including a controller adapted to selectively communicate the pressure from said pressure source;

f) a bladder connected to said pressure nozzle, said bladder adapted to be placed along with said draw tube inside said container, said bladder further including means such that, upon the communication of pressure through said pressure nozzle, said bladder expands, said expansion occurring first in the upper portion of said container, whereby attachment of said dispensing system to said container permits the selective release through said exit nozzle of liquid originally residing inside said container.

2. The liquid dispensing system of claim 1, wherein, during attachment of said dispensing system to said container, said selective release of said liquid causes said bladder to expand and occupy a further volume inside said container that is substantially equal to the volume of the released liquid, and wherein said bladder expansion occurs first in the top of said container, and subsequently, as sufficient liquid is released, in the bottom of said container.

3. The liquid dispensing system of claim 1, wherein said pressure nozzle is attached to said fastener.

4. The liquid dispensing system of claim 1, wherein said controller of said pressure nozzle is adapted to, in response to attachment of said fastener to said container, communicate pressure to said bladder from said pressure source, and to, in response to disattachment of said fastener to said container, prevent communication of pressure to said bladder from said pressure source.

5. The liquid dispensing system of claim 1, wherein said draw tube includes an aperture at its lowermost portion, and wherein said draw tube is adapted such that said aperture resides in the bottom region of said container when said fastener is attached to said container.

6. The liquid dispensing system of claim 1, wherein said bladder is adapted to expand progressively more readily towards its top.

7. The liquid dispensing system of claim 1, wherein said exit nozzle includes a faucet means for allowing the controlled delivery of dispensed liquid.

8. The liquid dispensing system of claim 1 wherein said draw tube is attached to and extends through the center of said bladder.

9. The liquid dispensing system of claim 8, wherein said draw tube is attached to said bladder at the top and bottom of said draw tube.

10. The liquid dispensing system of claim 1, wherein said draw tube is attached to said bladder at the top and bottom of said draw tube.

11. The liquid dispensing system of claim 10, wherein said bladder is adapted to expand progressively more readily towards its top.

12. A liquid dispensing system for use with a liquid container having a container aperture, comprising:

a) a housing adapted to attach to the container such that the container aperture is sealed;

b) a liquid exit nozzle attached to said housing;

c) a liquid draw tube connected to said exit nozzle and adapted to be placed inside of the container when said housing is attached to the container;

d) a pressure source;

e) a pressure nozzle connected to said pressure source and including a controller; and, f) a bladder connected to said pressure nozzle and adapted to be placed along with said draw tube inside the container, said bladder constructed so as to expand, when under pressure, progressively less readily from its top to its bottom.

13. The liquid dispensing system of claim 12, wherein said bladder has a wall thickness that gradually increases from its top to its bottom.

14. The liquid dispensing system of claim 12, wherein said controller includes a pressure sensor communicating with the interior of said bladder, and wherein said controller is adapted to control the communication of pressure through said pressure nozzle so as to maintain a substantially constant pressure in said bladder.

15. The liquid dispensing system of claim 12 wherein said draw tube is attached to and extends through the center of said bladder.

16. The liquid dispensing system of claim 12, wherein said draw tube is attached to said bladder at the top and bottom of said draw tube.

17. The liquid dispensing system of claim 12, wherein said dispensing system is adapted to be mounted in a refrigerator.

18. The liquid dispensing system of claim 12, wherein said dispensing system is adapted to be connected to other like dispensing systems.

19. The liquid dispensing system of claim 12, wherein said controller is adapted to, in response to attachment of said housing to the container, allow communication of pressure to said bladder from said pressure source, and to, in response to disattachment of said housing from the container, prevent communication of pressure to said bladder from said pressure source.

20. The liquid dispensing system of claim 19, wherein said controller includes a pin for opening said pressure nozzle in response to attachment of said housing to the container.

* * * * *